US011611180B2

(12) United States Patent
Burris et al.

(10) Patent No.: US 11,611,180 B2
(45) Date of Patent: Mar. 21, 2023

(54) COAXIAL CABLE CONNECTOR ASSEMBLIES WITH CONTAINED ADHESIVES AND METHODS FOR USING THE SAME

(71) Applicant: Corning Optical Communications RF LLC, Glendale, AZ (US)

(72) Inventors: Donald Andrew Burris, Peoria, AZ (US); Ming Feng Chien, New Taipei (TW); David Jeffrey Malouf, Surprise, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 17/348,821

(22) Filed: Jun. 16, 2021

(65) Prior Publication Data

US 2021/0399505 A1 Dec. 23, 2021

Related U.S. Application Data

(60) Provisional application No. 63/041,355, filed on Jun. 19, 2020.

(51) Int. Cl.

| | |
|---|---|
| ***H01R 24/40*** | (2011.01) |
| ***H01R 9/05*** | (2006.01) |
| ***H01R 4/04*** | (2006.01) |

(52) U.S. Cl.

CPC ..... *H01R 24/40* (2013.01); *H01R 4/04* (2013.01); *H01R 9/05* (2013.01)

(58) Field of Classification Search

None

See application file for complete search history.

(56) References Cited

U.S. PATENT DOCUMENTS

| | | | | |
|---|---|---|---|---|
| 4,919,510 | A | 4/1990 | Hoke et al. | |
| 7,331,820 | B2 * | 2/2008 | Burris | H01R 9/05 439/275 |
| 7,568,844 | B2 | 8/2009 | Luther et al. | |
| 7,614,918 | B1 | 11/2009 | Wu | |
| 8,137,133 | B2 * | 3/2012 | Malak | H01R 13/5205 439/578 |
| 8,974,259 | B2 | 3/2015 | Kuczynski et al. | |
| 9,239,435 | B2 | 1/2016 | Takahashi et al. | |
| 2005/0003709 | A1 | 1/2005 | Nagamine et al. | |

FOREIGN PATENT DOCUMENTS

| | | | |
|---|---|---|---|
| CN | 101536258 | A | 9/2009 |
| TW | 200903932 | A | 1/2009 |

* cited by examiner

*Primary Examiner* — Ross N Gushi

(74) *Attorney, Agent, or Firm* — Tamika A. Crawl-Bey

(57) ABSTRACT

A coaxial cable connector assembly includes a coupler defining an inner channel extending through the coupler and an outer conductor engagement feature extending inwardly from the inner channel, a rear body, positioned rearward of the coupler, defining a cable channel extending through the rear body, and structurally configured to receive the coaxial cable, and an adhesive reservoir positioned at least partially within the cable channel of the rear body, the adhesive reservoir including an adhesive and an adhesive reservoir breakable material that encapsulates the adhesive, where the adhesive reservoir breakable material is structurally configured to fracture upon the application of force exceeding a predetermined threshold, thereby releasing the adhesive from the adhesive reservoir to adhesively couple the coaxial cable to the rear body.

12 Claims, 6 Drawing Sheets

COAXIAL CABLE CONNECTOR ASSEMBLIES WITH CONTAINED ADHESIVES AND METHODS FOR USING THE SAME

CROSS-REFERENCE TO RELATED APPLICATIONS

This application claims the benefit of priority under 35 U.S.C. § 119 of U.S. Provisional Application Ser. No. 63/041,355, filed Jun. 19, 2020, the content of which is relied upon and incorporated herein by reference in its entirety.

BACKGROUND

The present disclosure relates to coaxial cable connector assemblies, and more particularly to coaxial cable connector assemblies with contained adhesives.

Coaxial cable connector assemblies, such as F-type connectors, are conventionally used to connect a coaxial cable to a device, such as a television or the like. Coaxial cables generally include an inner conductor, and an outer conductor extending around the inner conductor. In some configurations, signals are transmitted through the inner conductor, and the outer conductor may be maintained at earth potential.

Conventional cable connector assemblies are coupled to coaxial cables, and generally connect the inner conductor and the outer conductor of the coaxial cable to a receiving port of the receiving device.

BRIEF SUMMARY

In some instances, it may be difficult for a user, such as an installation technician, to couple the coaxial cable to the coaxial cable connector assembly. For example, some conventional coaxial cable connector assemblies may be coupled to a coaxial cable through the deformation of components of the coaxial cable connector assembly. However, it may require significant force to deform components of the coaxial cable connector assemblies and may require the use of cumbersome tools. Accordingly, a need exists for coaxial cable connector assemblies with contained adhesives that simplify the installation of a coaxial cable to the coaxial cable connector assembly.

In a first aspect A1, the present disclosure provides a coaxial cable connector assembly including a coupler defining an inner channel extending through the coupler between a front portion of the coupler and a rear portion of the coupler positioned opposite the front portion, and an outer conductor engagement feature extending inwardly from the inner channel and structurally configured to contact an outer conductor of a coaxial cable positioned at least partially within the coupler, a rear body, positioned rearward of the coupler, defining a cable channel extending through the rear body, and structurally configured to receive the coaxial cable, and an adhesive reservoir positioned at least partially within the cable channel of the rear body, the adhesive reservoir including an adhesive and an adhesive reservoir breakable material that encapsulates the adhesive, where the adhesive reservoir breakable material is structurally configured to fracture upon the application of a fracturing force exceeding a predetermined threshold, thereby releasing the adhesive from the adhesive reservoir to adhesively couple the coaxial cable to the rear body.

In a second aspect A2, the present disclosure provides the coaxial cable connector assembly of aspect A1, where the coupler includes a thread positioned at the front portion of the coupler, and where the thread is structurally configured to couple the coaxial cable connector assembly to a port of a device.

In a third aspect A3, the present disclosure provides the coaxial cable connector assembly of either of aspects A1 or A2, where the adhesive reservoir is an annular reservoir.

In a fourth aspect A4, the present disclosure provides the coaxial cable connector assembly of any of aspects A1-A3, further including an activator positioned on an inner surface of the cable channel of the rear body, where the activator is structurally configured to harden released adhesive.

In a fifth aspect A5, the present disclosure provides the coaxial cable connector assembly of any of aspects A1-A4, further including a tubular post positioned at least partially within the cable channel of the rear body.

In a sixth aspect A6, the present disclosure provides the coaxial cable connector assembly of aspect A5, further including an activator positioned on an inner surface of the cable channel of the rear body and an outer surface of the tubular post, where the activator is structurally configured to harden released adhesive.

In a seventh aspect A7, the present disclosure provides the coaxial cable connector assembly of any of aspects A1-A6, further including a hardener reservoir positioned at least partially within the cable channel of the rear body, the hardener reservoir including a hardener and a hardener reservoir breakable material that encapsulates the hardener, where the hardener reservoir breakable material is structurally configured to fracture upon application of a fracturing force exceeding a predetermined threshold, thereby releasing the hardener from the hardener reservoir to react with released adhesive.

In an eighth aspect A8, the present disclosure provides the coaxial cable connector assembly of any of aspects A1-A7, where the coaxial cable connector assembly further includes a plurality of reservoirs positioned at least partially within the cable channel of the rear body, each of the plurality of reservoirs including at least one of the adhesive and a hardener positioned within a hardener reservoir breakable material, where the hardener reservoir breakable material is structurally configured to fracture upon the application of a breaking force exceeding a predetermined threshold, thereby releasing the at least one of the adhesive and the hardener to couple the coaxial cable to the rear body.

In a ninth aspect A9, the present disclosure provides the coaxial cable connector assembly of any of aspects A1-A8, where the adhesive reservoir breakable material is structurally configured to fracture upon the application of a fracturing force as the coaxial cable is inserted into the rear body.

In a tenth aspect A10, the present disclosure provides the coaxial cable connector assembly of any of aspects A1-A9, further including a reservoir engagement member that is movable within the cable channel of the rear body and engageable with the adhesive reservoir.

In an eleventh aspect A11, the present disclosure provides the coaxial cable connector assembly of aspect A10, further including a reservoir rupturing member that is spaced apart from the reservoir engagement member, where the reservoir engagement member is positionable from a disengaged position, in which the adhesive is encapsulated within the adhesive reservoir, and an engaged position, in which the adhesive reservoir is engaged with the reservoir rupturing member.

In a twelfth aspect A12, the present disclosure provides the coaxial cable connector assembly of either of aspects A10 or A11, where the reservoir engagement member defines one or more channels extending through the reservoir engagement member, where the one or more channels allow released adhesive to pass through the reservoir engagement member.

In a thirteenth aspect A13, the present disclosure provides the coaxial cable connector assembly of any of aspects A10-A12, further including a hardener reservoir positioned at least partially within the cable channel of the rear body, the hardener reservoir including a hardener and a hardener reservoir breakable material that encapsulates the hardener, where the hardener reservoir breakable material of the hardener reservoir is structurally configured to fracture upon application of a breaking force exceeding a predetermined threshold, thereby releasing the hardener from the hardener reservoir to react with released adhesive, where the adhesive reservoir and the hardener reservoir are positioned on opposite sides of the reservoir engagement member.

In a fourteenth aspect A14, the present disclosure provides the coaxial cable connector assembly of any of aspects A10-A13, further including a hardener reservoir positioned at least partially within the cable channel of the rear body, the hardener reservoir including a hardener and a hardener reservoir breakable material that encapsulates the hardener, where the hardener reservoir breakable material of the hardener reservoir is structurally configured to fracture upon application of a breaking force exceeding a predetermined threshold, thereby releasing the hardener from the hardener reservoir to react with released adhesive, where the adhesive reservoir and the hardener reservoir are positioned on the same side of the reservoir engagement member. In some embodiments, the breaking force is up to about 2000 pounds.

In a fifteenth aspect A15, the present disclosure provides a method for coupling a coaxial cable to a coaxial cable connector assembly, the method including inserting a coaxial cable into a cable channel of a rear body of a coaxial cable connector assembly, the coaxial cable including an inner conductor, a dielectric material surrounding the inner conductor, an outer conductor surrounding the dielectric material, and an outer jacket surrounding the outer conductor, and where the coaxial cable connector assembly includes an adhesive reservoir positioned at least partially within the cable channel of the rear body, the adhesive reservoir including an adhesive and an adhesive reservoir breakable material that encapsulates the adhesive, engaging the outer conductor of the coaxial cable with an outer conductor engagement feature of the coaxial cable connector assembly, where the outer conductor engagement feature extends inwardly from an inner channel of a coupler of the coaxial cable connector assembly, and fracturing the adhesive reservoir breakable material of the adhesive reservoir, releasing the adhesive from the adhesive reservoir to couple the coaxial cable to the coaxial cable connector assembly.

In a sixteenth aspect A16, the present disclosure provides the method of aspect A15, where fracturing the adhesive reservoir breakable material includes engaging the coaxial cable with the adhesive reservoir.

In a seventeenth aspect A17, the present disclosure provides he method of either of aspects A15 or A16, where fracturing the adhesive reservoir breakable material includes applying a radial force to the rear body of the coaxial cable connector assembly.

In an eighteenth aspect A18, the present disclosure provides the method of any of aspects A15-A17, where fracturing the adhesive reservoir breakable material includes engaging a reservoir engagement member with the coaxial cable and moving the reservoir engagement member to contact the adhesive reservoir.

In a nineteenth aspect A19, the present disclosure provides the method of aspect A18, where fracturing the adhesive reservoir breakable material includes impinging the adhesive reservoir against a reservoir rupturing member with the reservoir engagement member.

In a twentieth aspect A20, the present disclosure provides the method of any of aspects A15-A19, further including fracturing a hardener reservoir breakable material of a hardener reservoir, thereby releasing hardener from the hardener reservoir, and reacting the released adhesive with the released hardener to couple the coaxial cable to the rear body of the coaxial cable connector assembly.

In a twenty-first aspect A21, the present disclosure provides the method of any of aspects A15-A20, further including reacting the released adhesive with an activator positioned on the rear body of the coaxial cable connector assembly to couple the coaxial cable to the rear body.

In a twenty-second aspect A22, the present disclosure provides a coaxial cable connector assembly including a coupler defining an inner channel extending through the coupler between a front portion of the coupler and a rear portion of the coupler positioned opposite the front portion, and an adhesive reservoir positioned at least partially within the coupler, the adhesive reservoir including an adhesive and an adhesive reservoir breakable material that encapsulates the adhesive, where the adhesive reservoir breakable material is structurally configured to fracture upon the application of a fracturing force exceeding a predetermined threshold, thereby releasing the adhesive from the adhesive reservoir to couple an inner conductor of a coaxial cable to the coupler.

In a twenty-third aspect A23, the present disclosure provides the coaxial cable connector assembly of aspect A22, where the coupler includes a thread at the front portion of the coupler, where the thread is structurally configured to couple the coaxial cable connector assembly to a port of a device.

In a twenty-fourth aspect A24, the present disclosure provides the coaxial cable connector assembly of either of aspects A22 or A23, further including an outer conductor engagement feature extending inwardly from the inner channel of the coupler and structurally configured to contact an outer conductor of the coaxial cable.

In a twenty-fifth aspect A25, the present disclosure provides the coaxial cable connector assembly of any of aspects A22-A24, including an inlet guide portion positioned rearward of the adhesive reservoir, and an exit portion positioned forward of the adhesive reservoir, where the inlet guide portion and the exit portion are structurally configured to receive the inner conductor of the coaxial cable.

In a twenty-sixth aspect A26, the present disclosure provides the coaxial cable connector assembly of aspect A25, where the exit portion defines a span that corresponds to a span of an inner conductor span of the inner conductor of the coaxial cable.

In a twenty-seventh aspect A27, the present disclosure provides the coaxial cable connector assembly of any of aspects A22-A26, where the coupler includes an outer jacket engagement feature that is structurally configured to engage an outer jacket of the coaxial cable.

In a twenty-eighth aspect A28, the present disclosure provides the coaxial cable connector assembly of any of aspects A22-A27, further including a hardener reservoir including a hardener and a hardener reservoir breakable material encapsulated by the hardener reservoir breakable material, where the hardener is structurally configured to react with the adhesive to couple the inner conductor to the coupler.

In a twenty-ninth aspect A29, the present disclosure provides the coaxial cable connector assembly of any of aspects A22-A28, where the adhesive reservoir positioned within a housing that is rotatably engaged with the coupler.

In a thirtieth aspect A30, the present disclosure provides a method for coupling a coaxial cable to a coaxial cable connector assembly, the method including inserting a coaxial cable into a coupler of a coaxial cable connector assembly, the coaxial cable including an inner conductor, a dielectric material surrounding the inner conductor, an outer conductor surrounding the dielectric material, and an outer jacket surrounding the outer conductor, and where the coaxial cable connector assembly includes an adhesive reservoir positioned at least partially within the coupler, the adhesive reservoir including an adhesive and an adhesive reservoir breakable material that encapsulates the adhesive, and fracturing the adhesive reservoir breakable material of the adhesive reservoir with the inner conductor of the coaxial cable, releasing the adhesive from the adhesive reservoir to couple the inner conductor to the coaxial cable connector assembly.

In a thirty-first aspect A31, the present disclosure provides the method of aspect A30, further including fracturing a hardener reservoir including a hardener encapsulated by a hardener reservoir breakable material, and reacting the hardener with the adhesive to couple the inner conductor the coaxial cable connector assembly.

In a thirty-second aspect A32, the present disclosure provides the method of either of aspects A30 or A31, further including rotating the coupler with respect to the coaxial cable.

In a thirty-third aspect A33, the present disclosure provides the method of any of aspects A30-A32, further including engaging the outer conductor of the coaxial cable with an outer conductor engagement feature that extends inwardly from an inner channel of the coupler.

In a thirty-fourth aspect A34, the present disclosure provides the method of any of aspects A30-A33, further including scraping excess adhesive from the inner conductor with an exit portion of the coupler as the coaxial cable is inserted into the coupler.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments described herein are generally directed to coaxial cable connector assemblies including contained adhesives. The contained adhesives may be released by breaking a breakable material encapsulating the adhesive, and the adhesive generally hardens to couple a coaxial cable to the coaxial cable connector assembly. In some embodiments, the breakable material may be broken by inserting the coaxial cable into the coaxial cable connector assembly. In some embodiments, the breakable material may be broken by a fracturing force applied to the coaxial cable connector assembly. In some embodiments, the fracturing force can be up to about 2000 pounds. Contained adhesives may reduce the amount of force required to couple the coaxial cable to the coaxial cable connector assembly, thereby reducing the burden on a user, such as a technician. These and other embodiments of coaxial cable connector assemblies are disclosed in greater detail herein with reference to the appended figures.

Figure 1:
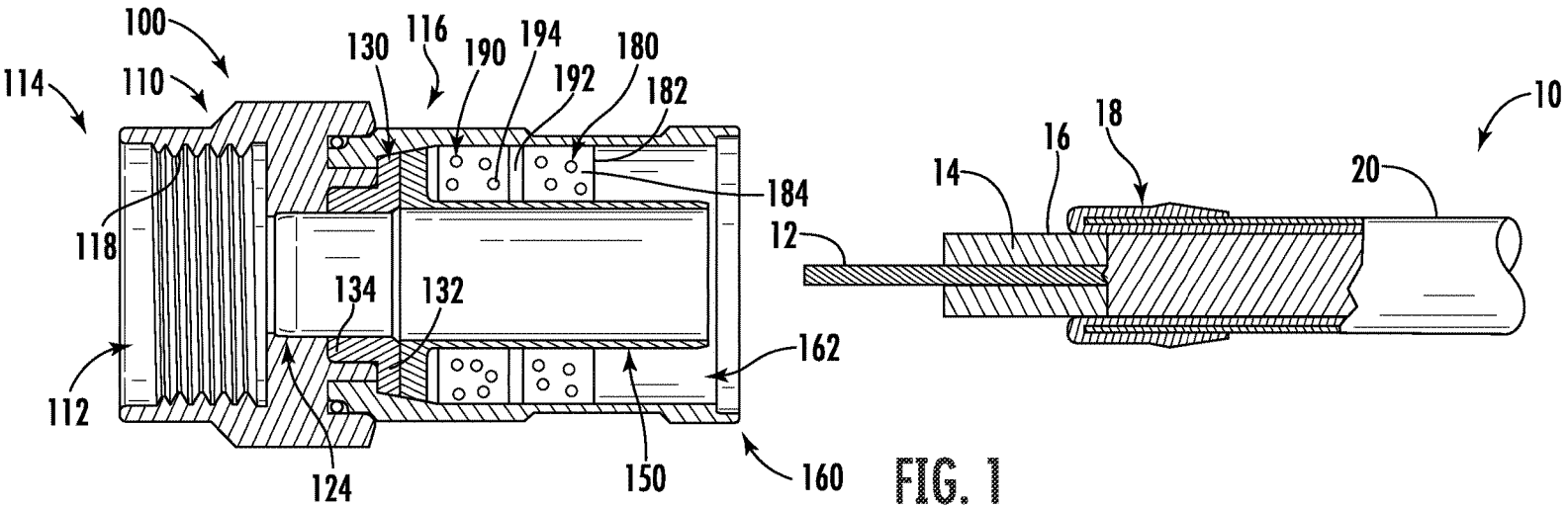
FIG. 1 schematically depicts a section view of a coaxial cable and coaxial cable connector assembly including an adhesive reservoir and a hardener reservoir, according to one or more embodiments shown and described herein.

Now referring to FIG. 1, a coaxial cable connector assembly 100 and a coaxial cable 1 are schematically depicted. The coaxial cable 10 generally includes an inner conductor 12 surrounded by a dielectric material 14. In embodiments, electrical signals may be passed through the inner conductor 12, such as to a device connected to the coaxial cable 10, and the inner conductor 12 may be formed of a conductive material, such as copper, aluminum, or the like. The dielectric material 14 generally electrically insulates the inner conductor 12, and may include a polymer or the like. In some embodiments, the dielectric material 14 is generally elastic and may allow the dielectric material 14 to elastically deform under force, thereby allowing the coaxial cable 10 to bend.

In embodiments, the coaxial cable 10 further includes an outer conductor 16 surrounding the dielectric material 14. In some configurations, the outer conductor 16 may be maintained at a ground potential while electrical signals are transmitted through the inner conductor 12. The outer conductor 16 may generally be formed of a conductive material, such as aluminum foil, copper foil, or the like. In some embodiments, the coaxial cable 10 further includes an outer braid 18 positioned outwardly from and engaged with the outer conductor 16. In embodiments, the outer braid 18 may be formed of a conductive material, such as braided copper wire, braided aluminum wire or the like. In embodiments, the outer braid 18 may assist in shielding the inner conductor 12 of the coaxial cable 10.

The coaxial cable 10, in embodiments, further includes an outer jacket 20 surrounding at least a portion of the outer conductor 16 and/or the outer braid 18. The outer jacket 20 may be formed of a polymer or the like and may generally protect the coaxial cable 10 from environmental elements, such as moisture.

The coaxial cable connector assembly 100 generally includes a coupler 110 and a rear body 160 positioned rearward of the coupler 110. In embodiments, the coupler 110 is rotatably engaged with the rear body 160, such that the coupler 110 may rotate about the rear body 160. The rear body 160 is generally coupled to the coaxial cable 10, as described in greater detail herein.

In embodiments, the coupler 110 defines an inner channel 112 extending between a front portion 114 of the coupler 110 and a rear portion 116 of the coupler 110 positioned opposite the front portion 114. In embodiments, the coupler 110 defines a thread 118 at the front portion 114 of the coupler 110. The thread 118, in embodiments, is structurally configured to engage a corresponding thread of a port of a device, such as a television, a cable box, or the like to couple the coaxial cable connector assembly 100 to the port of the device. The coupler 110 may be formed of a material suitable to conduct electricity, such as copper, brass, aluminum, or the like, and in embodiments, the coupler 110 is electrically coupled to the outer conductor 16 of the coaxial cable 10, as described in greater detail herein.

In some embodiments, the coaxial cable connector assembly 100 includes an outer conductor engagement feature 124 that extends inwardly from the inner channel 112 of the coupler 110. The outer conductor engagement feature 124 is structurally configured to contact the outer conductor 16 of the coaxial cable 10 when the coaxial cable 10 is positioned at least partially within the coupler 110. Through contact with the outer conductor 16, the outer conductor engagement feature 124 may electrically couple the thread 118 of the coupler 110 to the outer conductor 16 of the coaxial cable 10. By electrically coupling the thread 118 of the coupler 110 to the outer conductor 16 of the coaxial cable 10, the coaxial cable connector assembly 100 may facilitate electrical connection between the outer conductor 16 of the coaxial cable 10 and the port of a device, even when the coupler 110 is not fully seated on the port of the device.

In the embodiment depicted in FIG. 1, the outer conductor engagement feature 124 includes a taper extending inwardly and forwardly along the coupler 110 to the front portion 114 of the coupler 110, where the taper is structurally configured to contact the outer conductor 16 of the coaxial cable 10. However, it should be understood that the outer conductor engagement feature 124 may include any suitable feature structurally configured to contact the outer conductor 16 of a coaxial cable 10 at least partially inserted within the coupler 110. For example and without limitation, the outer conductor engagement feature 124 may include one or more radial bulges extending inwardly from the inner channel 112 of the coupler 110, one or more protrusions extending inwardly from the inner channel 112 of the coupler 110, or the like.

In some embodiments, the coaxial cable connector assembly 100 includes a retainer 130 engaged with the coupler 110 and the rear body 160. In these embodiments, the retainer 130 generally couples the coupler 110 to the rear body 160. For example, in embodiments, the retainer 130 includes a flange 132 that extends outwardly from a tubular portion 134 of the retainer 130. In embodiments, the flange 132 of the retainer 130 may be engaged with the rear body 160, and the tubular portion 134 may be coupled to the coupler 110, such that the coupler 110 is rotatably coupled to the rear body 160 through the retainer 130. While in the embodiment depicted in FIG. 1, the coupler 110 defines the outer conductor engagement feature 124, it should be understood that in some embodiments, the retainer 130 may define the outer conductor engagement feature 124, and in some embodiments both the retainer 130 and the coupler 110 may define other outer conductor engagement features structurally configured to contact the outer conductor 16 of the coaxial cable 10. In embodiments, the retainer 130 is formed from an electrically conductive material, such as and without limitation, copper, brass, aluminum, or the like. While in the embodiment depicted in FIG. 1, the retainer 130 is depicted as including the flange 132 and the tubular portion 134, it should be understood that this is merely an example. For example, in some embodiments, the retainer 130 may include an annular ring or the like that rotatably couples the rear body 160 to the coupler 110.

In embodiments, the rear body 160 defines a cable channel 162 extending through the rear body 160. The cable channel 162 is structurally configured to receive the coaxial cable 10 as the coaxial cable 10 is inserted within the coaxial cable connector assembly 100.

In some embodiments, the coaxial cable connector assembly 100 further includes a tubular post 150 positioned at least partially within the cable channel 162 of the rear body 160. In embodiments, the tubular post 150 may be inserted between the outer braid 18 of the coaxial cable 10 and the dielectric material 14 or between the outer braid 18 and the outer conductor 16 of the coaxial cable 10. In some embodiments, the tubular post 150 may make an electrical connection with the outer braid 18 and/or the outer conductor 16 of the coaxial cable 10.

In embodiments, the coaxial cable connector assembly 100 includes an adhesive reservoir 180 positioned at least partially within the cable channel 162 of the rear body 160.

In the embodiment depicted in FIG. 1, the coaxial cable connector assembly 100 includes the adhesive reservoir 180 and a hardener reservoir 190. In embodiments in which the coaxial cable connector assembly 100 includes the tubular post 150, the adhesive reservoir 180 and/or the hardener reservoir 190 may be formed as annular reservoirs positioned between the rear body 160 and the tubular post 150.

The adhesive reservoir 180 generally includes an adhesive reservoir breakable material 182 that encapsulates an adhesive 184. Similarly, the hardener reservoir 190 includes a hardener reservoir breakable material 192 that encapsulates a hardener 194. In some embodiments, the hardener 194 includes a material that is structurally configured to react with the adhesive 184. For example in some embodiments, the adhesive 184 is initially in a fluid state, and upon reaction with the hardener 194 over a period of time, the adhesive 184 hardens to a solid state. The hardener 194 may include any suitable composition for reacting with the adhesive 184 to harden the adhesive 184, and may include, for example and without limitation, borax or the like. In embodiments, the adhesive reservoir breakable material 182 of the adhesive reservoir 180, and the hardener reservoir breakable material 192 of the hardener reservoir 190 may include any suitable rupturable, tearable, and/or frangible material structurally configured to break upon the application of a force exceeding a predetermined threshold.

Figure 2:
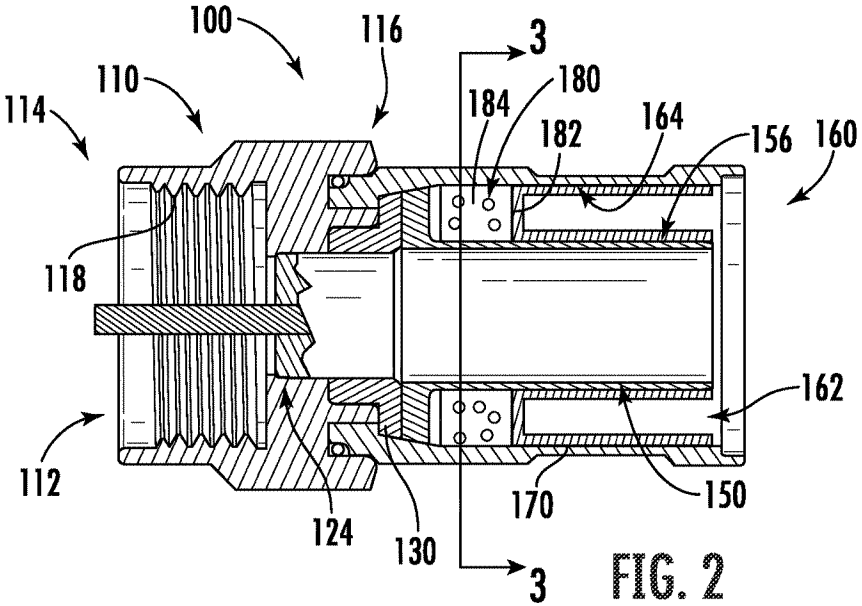
FIG. 2 schematically depicts a section view of a coaxial cable connector assembly including an adhesive reservoir and an activator, according to one or more embodiments shown and described herein.

Referring to FIG. 2, a section view of another coaxial cable connector assembly 100 is schematically depicted. Similar to the embodiment described above and depicted in FIG. 1, the coaxial cable connector assembly 100 includes the coupler 110, the rear body 160, and the retainer 130. However, in the embodiment depicted in FIG. 2, the coaxial cable connector assembly 100 includes the adhesive reservoir 180 including the adhesive 184 encapsulated by the adhesive reservoir breakable material 182, but does not include the hardener reservoir 190 (FIG. 1). In embodiments in which the coaxial cable connector assembly 100 includes just the adhesive reservoir 180, the adhesive 184 may harden once released from the adhesive reservoir 180, for example as the adhesive 184 is exposed to water, such as humidity within air. In some embodiments, the coaxial cable connector assembly 100 includes an activator 170 positioned on an inner surface 164 of the rear body 160 and/or an outer surface 156 of the tubular post 150. In embodiments, the activator 170 includes a compound structurally configured to harden adhesive 184 released from the adhesive reservoir 180 from a fluid state to a solid state. In some embodiments, the activator 170 may include, for example and without limitation, an alkali compound or the like.

In some embodiments, the coaxial cable connector assembly 100 includes a plurality of reservoirs. For example and referring to FIG. 3, a section view of the coaxial cable connector assembly 100 along section 3-3 of FIG. 2 is schematically depicted. In the embodiment depicted in FIG. 3, the coaxial cable connector assembly 100 includes four adhesive or hardener reservoirs 180, 190 arranged around the rear body 160. Similar to the embodiments described above, each of the adhesive and hardener reservoirs 180, 190 include a breakable material 182, 192 that is structurally configured to break upon the application of a fracturing force exceeding a predetermined threshold. In some embodiments, each of the plurality of reservoirs include adhesive 184 encapsulated by the adhesive reservoir breakable material 182. In some embodiments, some of the plurality of reservoirs include the adhesive 184 encapsulated by the adhesive reservoir breakable material 182, and others of the plurality of reservoirs include the hardener 194 encapsulated by the hardener reservoir breakable material 192. For example, in some embodiments, adhesive reservoirs 180 may alternate with hardener reservoirs 190 moving around the circumference of the rear body 160. In some embodiments, adhesive reservoirs 180 may be adjacent to other adhesive reservoirs 180, and hardener reservoirs 190 may be adjacent to other hardener reservoirs 190. While in the embodiment depicted in FIG. 3 the plurality of reservoirs includes four adhesive and hardener reservoirs 180, 190, it should be understood that this is merely an example, and the plurality of reservoirs of the coaxial cable connector assembly 100 may include any suitable number of reservoirs. Additionally, while in the embodiment depicted in FIG. 3, each of the plurality of reservoirs are depicted as being spaced apart from one another about the circumference of the rear body 160, it should be understood that in some embodiments, adhesive reservoirs 180 and hardener reservoirs 190 may be spaced apart from one another about the circumference of the rear body 160 and along an axial direction of the rear body 160. Moreover, while in the embodiment depicted in FIG. 3, the adhesive reservoirs 180 and the hardener reservoirs are depicted as including a "kidney" shaped cross-section, it should be understood that the adhesive and hardener reservoirs 180, 190 may include any suitable cross-sectional shape.

Figure 3:
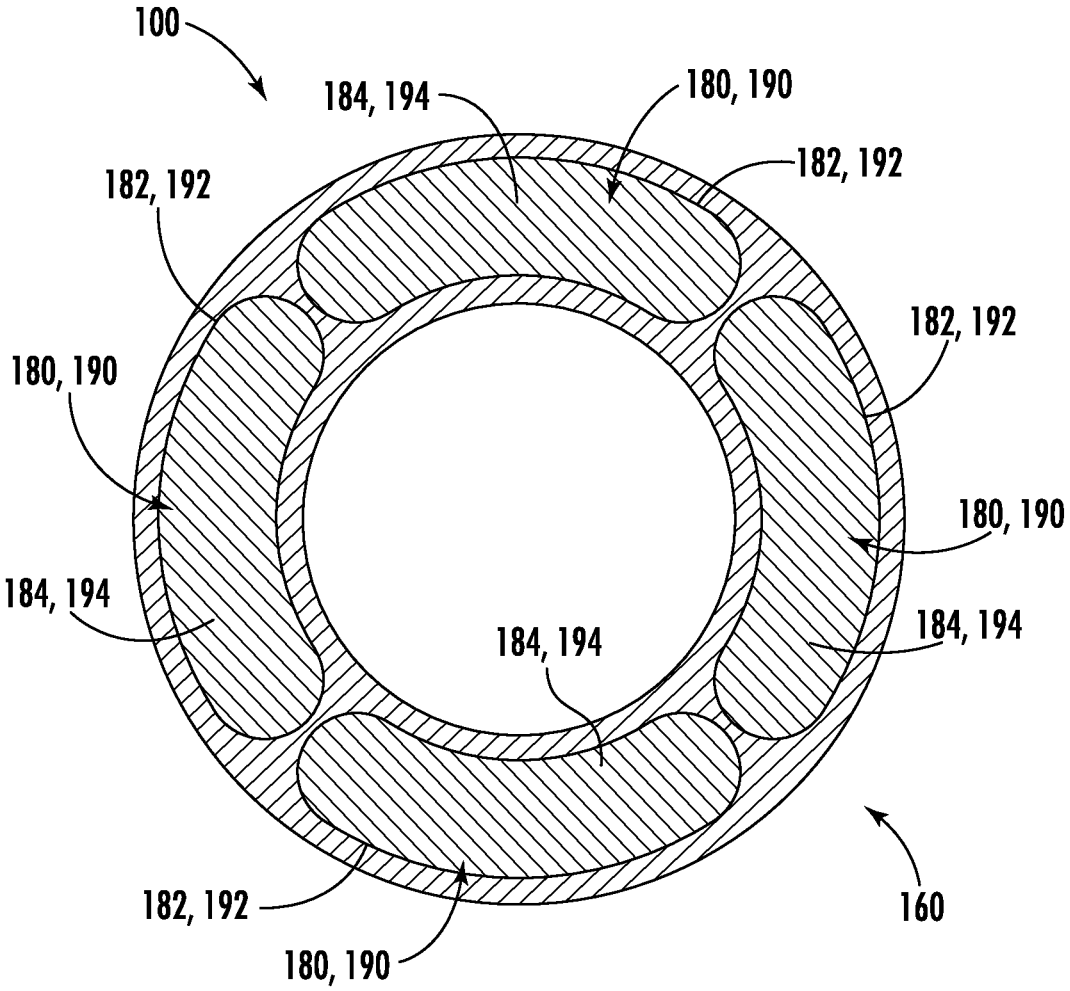
FIG. 3 schematically depicts a section view of the coaxial cable connector assembly along section 3-3 of FIG. 2, according to one or more embodiments shown and described herein.

Referring collectively to FIGS. 1, 2, and 3, to assemble the coaxial cable 10 to the coaxial cable connector assembly 100, the coaxial cable 10 is inserted into the cable channel 162 of the rear body 160. In embodiments in which the coaxial cable connector assembly 100 includes a tubular post 150, the tubular post 150 may be inserted between the outer conductor 16 and the outer braid 18. As the coaxial cable 10 is inserted axially along the rear body 160, the coaxial cable 10 contacts the adhesive reservoir 180 and/or the hardener reservoir 190. For example, in some embodiments, the outer braid 18 may be folded back over the outer jacket 20 of the coaxial cable 10, and as the coaxial cable 10 is inserted into the cable channel 162 of the rear body 160, the outer braid 18 may contact the adhesive reservoir 180 and/or the hardener reservoir 190.

With the coaxial cable 10 in contact with the adhesive reservoir 180 and/or the hardener reservoir 190, further insertion of the coaxial cable 10 into the coaxial cable connector assembly 100 imparts a force on the adhesive reservoir 180 and/or the hardener reservoir 190. When the force exceeding a predetermined threshold is applied to the adhesive reservoir 180 and/or the hardener reservoir 190 (e.g., via the coaxial cable 10), the adhesive reservoir breakable material 182 of the adhesive reservoir 180 and/or the hardener reservoir breakable material 192 of the hardener reservoir 190 fractures, releasing the adhesive 184 from the adhesive reservoir 180 and releasing the hardener 194 from the hardener reservoir 190. In embodiments including one or more adhesive reservoirs 180 and one or more hardener reservoirs 190, the released adhesive 184 reacts with the released hardener 194 to solidify and couple the coaxial cable 10 to the coaxial cable connector assembly 100. In embodiments that only include one or more adhesive reservoirs 180, the released adhesive 184 may react with water (i.e., humidity in air) and/or the activator 170 positioned on the rear body 160 and/or the tubular post 150 to solidify and couple the coaxial cable 10 to the coaxial cable connector assembly 100.

As the coaxial cable 10 is inserted into the coaxial cable connector assembly 100, the outer conductor 16 and/or the outer braid 18 contacts the outer conductor engagement feature 124. Contact between the outer conductor 16 and/or the outer braid 18 of the coaxial cable 10 and the outer conductor engagement feature 124, in embodiments, electrically couples the threads 118 of the coupler 110 to the outer conductor 16 and/or the outer braid 18. As noted above, the outer conductor 16 and/or the outer braid 18 may be maintained at ground potential, and may be connected to a port of a device. By electrically coupling the outer conductor 16 and/or the outer braid 18 to the threads 118 of the coupler 110, electrical connection between the outer conductor and/or the outer braid 18 and the port of the device may be accomplished even if the coupler 110 is not fully seated or tightened onto the port of the device.

Figure 4A:
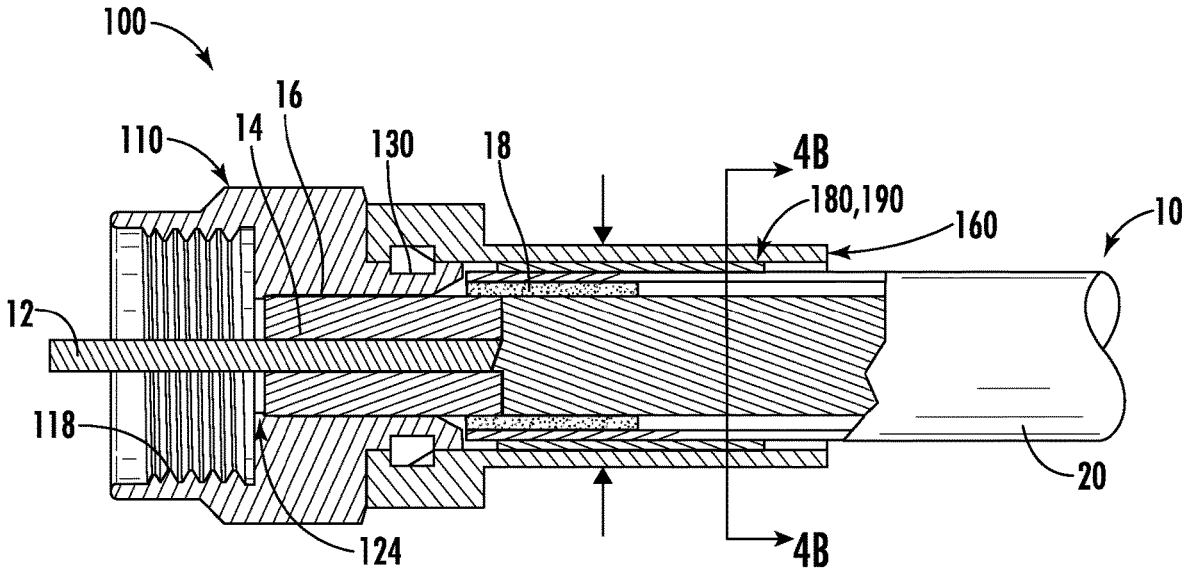
FIG. 4A schematically depicts a section view of another coaxial cable connector assembly, according to one or more embodiments shown and described herein.
Figure 4B:
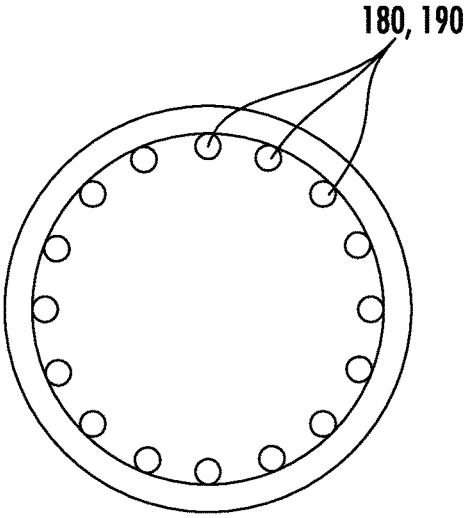
FIG. 4B schematically depicts a section view of the coaxial cable connector assembly along section 4B-4B of FIG. 4A, according to one or more embodiments shown and described herein.
Figure 4C:
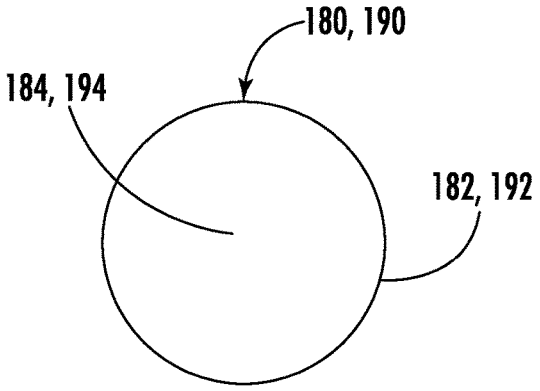
FIG. 4C schematically depicts an enlarged section view of a reservoir of the coaxial cable connector assembly of FIG. 4B, according to one or more embodiments shown and described herein.

Referring to FIGS. 4A, 4B, and 4C, section views of another embodiment of a coaxial cable connector assembly 100 and an enlarged view of a reservoir 180, 190 are schematically depicted. Similar to the embodiments described above, the coaxial cable connector assembly 100 includes the coupler 110, the retainer 130, and the rear body 160. Furthermore, in the embodiment depicted in FIGS. 4A and 4B, the coaxial cable connector assembly 100 includes the plurality of reservoirs (i.e., the adhesive reservoirs 180 and the hardener reservoirs 190) extending around an inner circumference of the rear body 160. However, in the embodiment depicted in FIGS. 4A and 4B, the plurality of reservoirs are positioned on the rear body 160 such that the coaxial cable 10 is insertable within the rear body 160 without fracturing the plurality of reservoirs. Instead, once the coaxial cable 10 is fully inserted within the coaxial cable connector assembly 100, radial force may be applied to the rear body 160 to compress the adhesive reservoirs 180 and/or the hardener reservoirs 190 against the coaxial cable 10 to fracture the adhesive reservoirs 180 and/or the hardener reservoirs 190. For example, in some embodiments, as radial force is applied to the rear body 160, the adhesive reservoirs 180 and/or the hardener reservoirs 190 are compressed between the rear body 160 and the coaxial cable 10. Upon the application of a radial force exceeding a predetermined threshold, the adhesive reservoir breakable material 182 of the adhesive reservoirs 180 and/or the hardener reservoir breakable material 192 of the hardener reservoirs 190 fracture, releasing the adhesive 184 and/or the hardener 194. In embodiments, the radial force applied to the rear body 160 may be applied by a user, such as a technician, and in some embodiments, a tool such as pliers or the like may be utilized to apply the radial force. By releasing the adhesive 184 and/or the hardener 194 from the adhesive reservoirs 180 and hardener reservoirs 190 upon the application of a radial force, the coaxial cable 10 may be fully inserted into the coaxial cable connector assembly 100 before the adhesive 184 and/or the hardener 194 is released, which may allow the coaxial cable 10 to be positioned with respect to the coaxial cable connector assembly 100 as desired before the coaxial cable 10 is coupled to the coaxial cable connector assembly 100.

Figure 5:
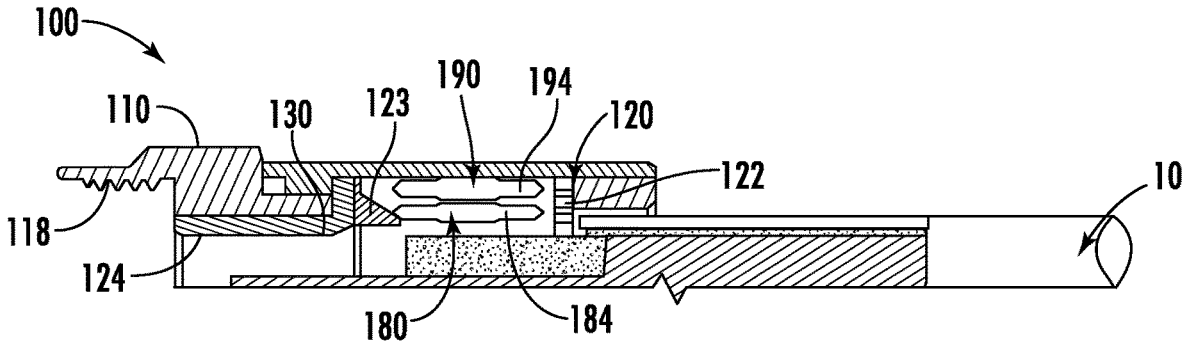
FIG. 5 schematically depicts a section view of another coaxial cable connector assembly including a reservoir engagement member, according to one or more embodiments shown and described herein.

Referring to FIG. 5, another embodiment of a coaxial cable connector assembly 100 is schematically depicted. Similar to the embodiments described above, the coaxial cable connector assembly 100 includes the coupler 110, the rear body 160, and the retainer 130. In the embodiment depicted in FIG. 5, the coaxial cable connector assembly 100 further includes an adhesive reservoir 180 and a hardener reservoir 190. However, in the embodiment depicted in FIG. 5, the coaxial cable connector assembly 100 includes a reservoir engagement member 120 that is movable within the cable channel 162 of the rear body 160. In embodiments, as the coaxial cable 10 is inserted within the cable channel 162, the coaxial cable 10 engages the reservoir engagement member 120 and moves the reservoir engagement member 120 forward along the cable channel 162 in the axial direction. As the reservoir engagement member 120 moves forward along the cable channel 162, the reservoir engagement member 120, in embodiments, fractures the adhesive reservoir 180 and/or the hardener reservoir 190, thereby releasing the adhesive 184 and/or the hardener 194. In some embodiments, the reservoir engagement member 120 is shaped to define one or more channels 122 extending through the reservoir engagement member 120 that allow released adhesive 184 and/or released hardener 194 to pass through from one side of the reservoir engagement member 120 to the other in the axial direction. In embodiments, the reservoir engagement member 120 defines an annular shape extending around the rear body 160 of the coaxial cable connector assembly 100, however, it should be understood that this is merely an example. In embodiments, the reservoir engagement member 120 may define any suitable shape to move within the cable channel 162 of the rear body 160 and engage the adhesive reservoir 180 and/or the hardener reservoir 190.

In some embodiments, the coaxial cable connector assembly 100 further includes a reservoir rupturing member 123 spaced apart from the reservoir engagement member 120. As the coaxial cable 10 and the reservoir engagement member 120 move forward along the cable channel 162 in the axial direction, the reservoir engagement member 120 is positionable from a disengaged position to an engaged position with respect to the reservoir rupturing member 123. In the disengaged position, the adhesive 184 is encapsulated within the adhesive reservoir 180. In the embodiment depicted in FIG. 5, when the reservoir engagement member 120 is in the disengaged position, the hardener 194 is encapsulated within the hardener reservoir 190. As the coaxial cable 10 and the reservoir engagement member 120 move forward, the reservoir engagement member 120 causes the adhesive reservoir 180 and/or the hardener reservoir 190 to engage the reservoir rupturing member 123. As the adhesive reservoir 180 and/or the hardener reservoir 190 engage the reservoir rupturing member 123, the adhesive reservoir 180 and/or the hardener reservoir 190 fracture, releasing the adhesive 184 and/or the hardener 194. In the embodiment depicted in FIG. 5, the reservoir rupturing member 123 defines a triangular "blade shape," however, it should be understood that the reservoir rupturing member 123 may define any suitable shape for engaging and fracturing the adhesive reservoir 180 and/or the hardener reservoir 190.

Figure 6A:
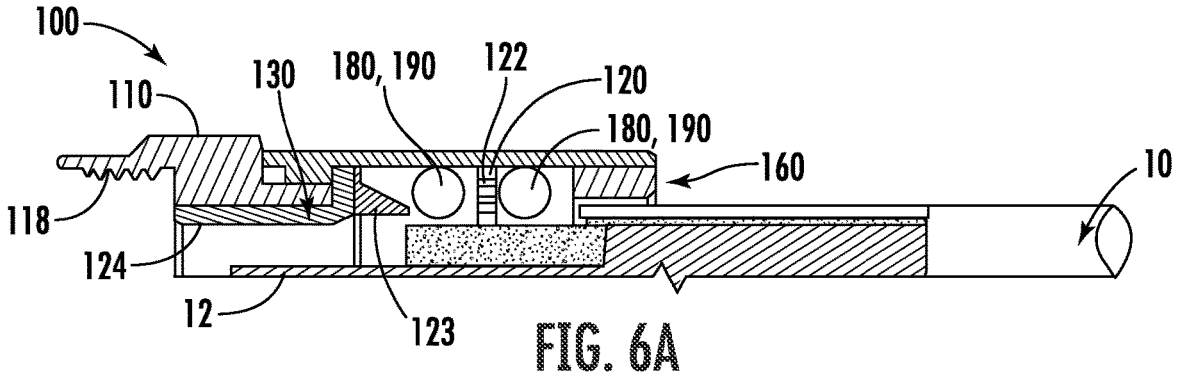
FIG. 6A schematically depicts a section view of another coaxial cable connector assembly with a coaxial cable being inserted into the coaxial cable connector assembly, according to one or more embodiments shown and described herein.
Figure 6B:
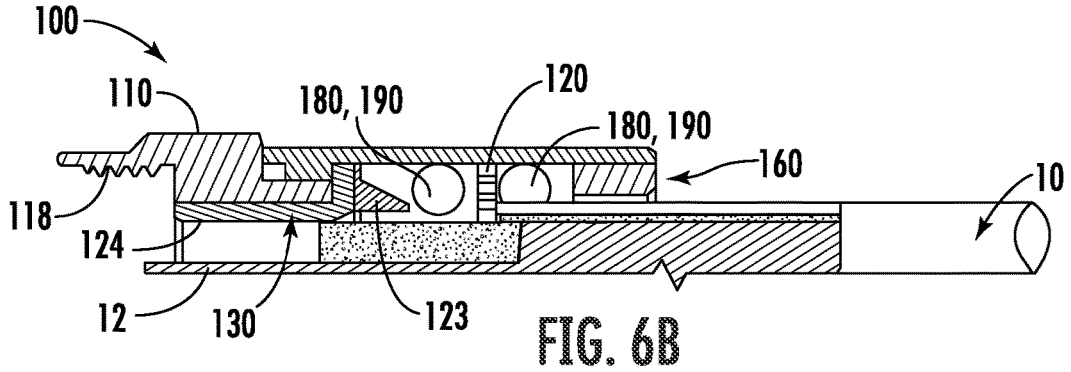
FIG. 6B depicts a section view of the coaxial cable connector assembly of FIG. 6A with the coaxial cable further inserted into the coaxial cable connector assembly, according to one or more embodiments shown and described herein.
Figure 6C:
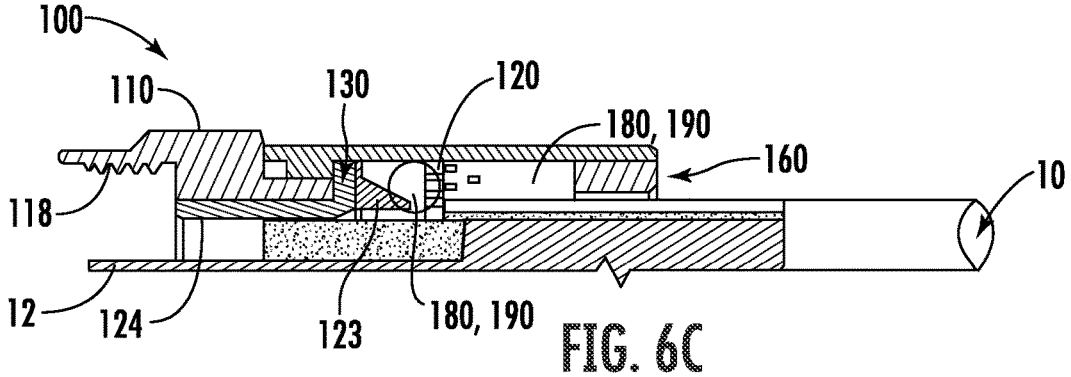
FIG. 6C depicts a section view of the coaxial cable connector assembly of FIG. 6A with the coaxial cable fully inserted into the coaxial cable connector assembly, according to one or more embodiments shown and described herein.

While in the embodiment depicted in FIG. 5 the adhesive reservoir 180 and the hardener reservoir 190 are positioned on the same side of the reservoir engagement member 120 in the axial direction, it should be understood that this is merely an example. For example and referring to FIG. 6A, in some embodiments, an adhesive reservoir 180 or a hardener reservoir 190 is positioned on one side of the reservoir engagement member 120, and another adhesive reservoir 180 or hardener reservoir 190 is positioned on the other side of the reservoir engagement member 120 in the axial direction. As shown in FIGS. 6A-6C, as the coaxial cable 10 moves forward in the axial direction, the adhesive reservoir 180 or hardener reservoir 190 positioned forward of the reservoir engagement member 120 is pushed by the reservoir engagement member 120 into the reservoir rupturing member 123 to fracture the adhesive reservoir 180 or the hardener reservoir 190. The adhesive reservoir 180 or the hardener reservoir 190 positioned rearward of the reservoir engagement member 120 may be fractured through contact with the coaxial cable 10 and/or the rear body 160.

Figure 7:
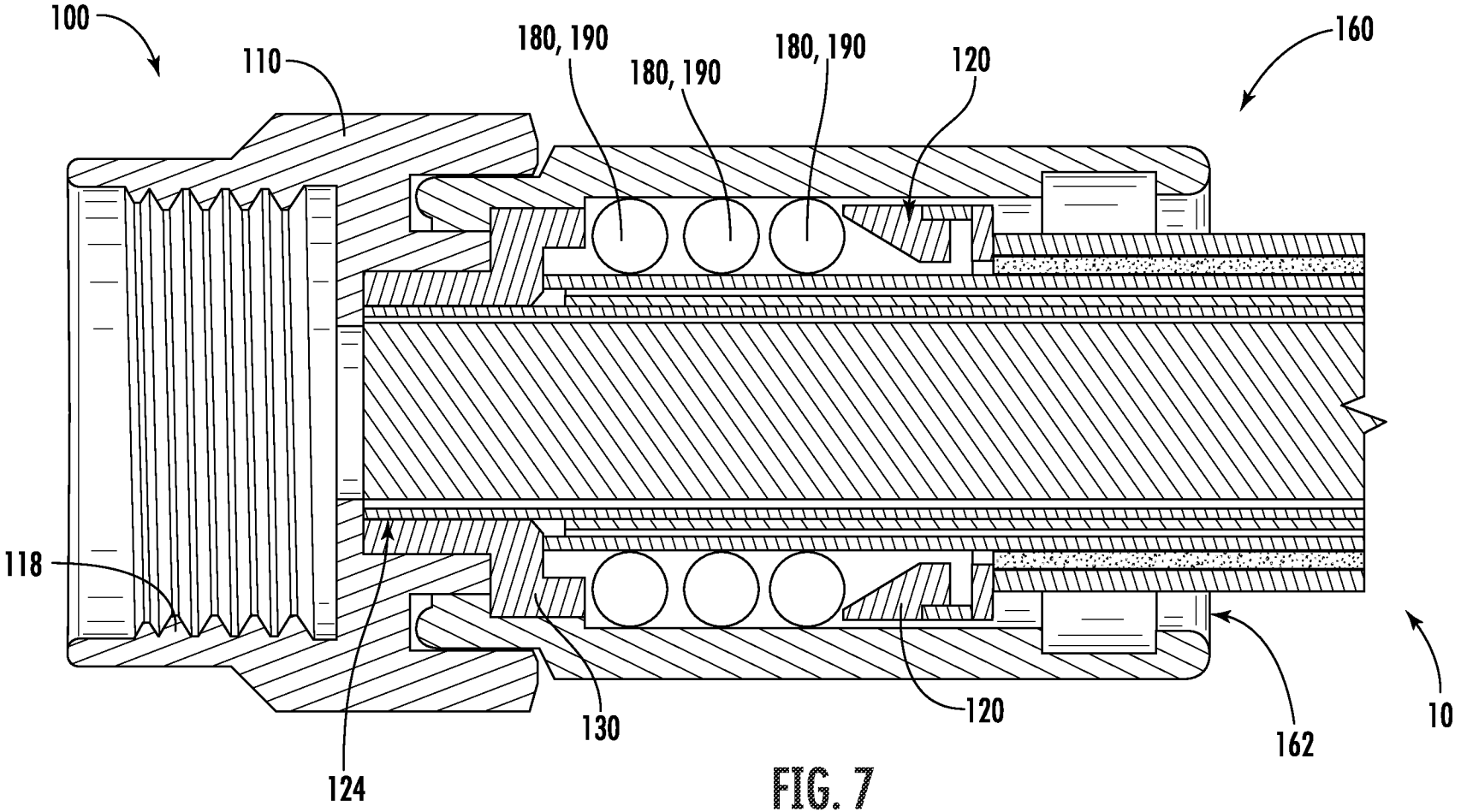
FIG. 7 schematically depicts another coaxial cable connector assembly including a reservoir engagement member, according to one or more embodiments shown and described herein.

Referring to FIG. 7, another embodiment of a coaxial cable connector assembly 100 is schematically depicted. Like the embodiments described above, the coaxial cable connector assembly 100 includes the coupler 110, the retainer 130, and the rear body 160. However, in the embodiment depicted in FIG. 7, the reservoir engagement member 120 defines a blade shape that is structurally configured to fracture the adhesive reservoirs 180 and/or the hardener reservoirs 190 as the reservoir engagement member 120 moves forward along the rear body 160.

Figure 8:
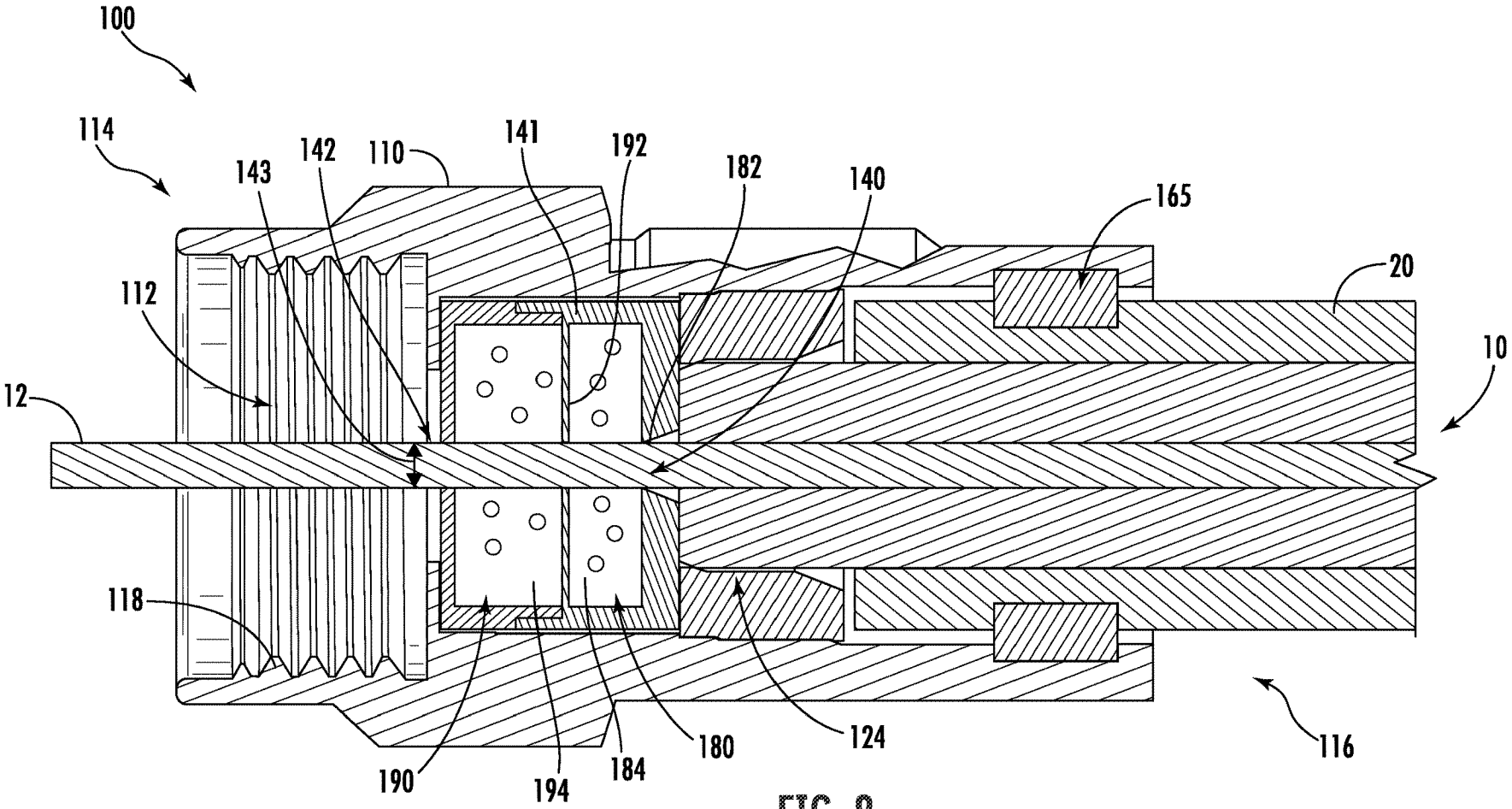
FIG. 8 schematically depicts another coaxial cable connector assembly including an adhesive reservoir positioned within a coupler, according to one or more embodiments shown and described herein.

Referring to FIG. 8, another embodiment of the coaxial cable connector assembly 100 is schematically depicted. Like the embodiments described above, the coaxial cable connector assembly 100 includes the coupler 110 and the adhesive reservoir 180. However, in the embodiment depicted in FIG. 8, the adhesive reservoir 180 is positioned at least partially within the coupler 110. In the embodiment depicted in FIG. 8, the coaxial cable connector assembly 100 further includes the hardener reservoir 190 positioned at least partially within the coupler 110. In embodiments, the adhesive reservoir 180 and/or the hardener reservoir 190 are positioned within a housing 141 that is positioned within the coupler 110. In embodiments, the housing 141 may be captured within the coupler 110 (i.e., the housing 141 is generally restricted from moving in the axial direction with respect to the coupler 110). In some embodiments, the housing 141 is rotatably engaged with the coupler 110 such that the housing 141 rotatable with respect to the coupler 110.

In embodiments, the coaxial cable connector assembly 100 includes an inlet guide portion 140 that is positioned rearward of the adhesive reservoir 180 and an exit portion 142 that is positioned forward of the adhesive reservoir 180. In embodiments, the inlet guide portion 140 and the exit portion 142 are structurally configured to receive the inner conductor 12 of the coaxial cable 10. For example, the inlet guide portion 140 and the exit portion 142 may guide the inner conductor 12 of the coaxial cable 10 to pass through the adhesive reservoir 180. In the embodiment depicted in FIG. 8, the inlet guide portion 140 and the exit portion 142 are defined by the housing 141 positioned within the coupler 110, however, this is merely an example. For example, in some embodiments, the inlet guide portion 140 and the exit portion 142 may be defined by and may be integral with the coupler 110. In embodiments, the exit portion 142 defines a span 143 that corresponds to the span of the inner conductor 12 of the coaxial cable 10. By defining the span 143 that corresponds to the span of the inner conductor 12 of the coaxial cable 10, excess adhesive 184 that may be attached to the inner conductor 12 as the inner conductor 12 pierces the adhesive reservoir 180 may be "scraped" from the inner conductor 12, as the inner conductor 12 passes through the exit portion 142.

In some embodiments, the coupler 110 comprises an outer jacket engagement feature 165 that is structurally configured to engage the outer jacket 20 of the coaxial cable 10. The outer jacket engagement feature 165 may assist in allowing the coupler 110 to rotate with respect to the coaxial cable 10, as described in greater detail herein.

To install the coaxial cable 10 to the coupler 110, the inner conductor 12 is inserted into the inlet guide portion 140 and breaks the adhesive reservoir breakable material 182 of the adhesive reservoir 180. As the coaxial cable 10 is further inserted, in embodiments that include the hardener reservoir 190, the inner conductor 12 breaks the hardener reservoir breakable material 192 of the hardener reservoir 190, and the hardener 194 and the adhesive 184 react with one another. The coaxial cable 10 is further inserted through the exit portion 142, which guides the inner conductor 12 to the front portion 114 of the coupler 110, and the exit portion 142 may scrape adhesive 184 from the inner conductor 12 as the inner conductor 12 passes through the exit portion 142.

As the adhesive 184 solidifies, for example by reacting with the hardener 194, the adhesive 184 couples the inner conductor 12 of the coaxial cable 10 to the housing 141. As noted above, the housing 141 is generally captured by the coupler 110, and accordingly, the inner conductor 12 of the coaxial cable 10 is coupled to the coupler 110 through the adhesive 184 and the housing 141. As noted above, the housing 141 is rotatably engaged with the coupler 110, such that the coupler 110 may remain free to rotate with respect to the coaxial cable 10, such that the coaxial cable connector assembly 100 may be coupled to a port of a device.

Accordingly, it should now be understood that embodiments described herein are directed coaxial cable connector assemblies including contained adhesives. The contained adhesives may be released by breaking a breakable material encapsulating the adhesive, and the adhesive generally hardens to couple a coaxial cable to the coaxial cable connector assembly. In some embodiments, the breakable material may be broken by inserting the coaxial cable into the coaxial cable connector assembly. In some embodiments, the breakable material may be broken by a radial force applied to the coaxial cable connector assembly. Contained adhesives may reduce the amount of force required to couple the coaxial cable to the coaxial cable connector assembly, thereby reducing the burden on a user, such as a technician Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A coaxial cable connector assembly, comprising:

a coupler defining:

an inner channel extending through the coupler between a front portion of the coupler and a rear portion of the coupler positioned opposite the front portion; and an outer conductor engagement feature extending inwardly from the inner channel and structurally configured to contact an outer conductor of a coaxial cable positioned at least partially within the coupler;

a rear body, positioned rearward of the coupler, defining a cable channel extending through the rear body, and structurally configured to receive the coaxial cable;

an adhesive reservoir positioned at least partially within the cable channel of the rear body, the adhesive reservoir comprising an adhesive and an adhesive reservoir breakable material that encapsulates the adhesive, wherein the adhesive reservoir breakable material is structurally configured to fracture upon the application of a fracturing force exceeding a predetermined threshold, thereby releasing the adhesive from the adhesive reservoir to adhesively couple the coaxial cable to the rear body, and a reservoir engagement member, movable within the cable channel of the rear body and engageable with the adhesive reservoir, the reservoir engagement member, defining one or more channels extending through the reservoir engagement member, wherein the one or more channels allow released adhesive to pass through the reservoir engagement member.

2. The coaxial cable connector assembly of claim 1, wherein the coupler comprises a thread positioned at the front portion of the coupler, and wherein the thread is structurally configured to couple the coaxial cable connector assembly to a port of a device.

3. The coaxial cable connector assembly of claim 1, wherein the adhesive reservoir is an annular reservoir.

4. The coaxial cable connector assembly of claim 1, further comprising an activator positioned on an inner surface of the cable channel of the rear body, wherein the activator is structurally configured to harden released adhesive.

5. The coaxial cable connector assembly of claim 1, further comprising a tubular post positioned at least partially within the cable channel of the rear body.

6. The coaxial cable connector assembly of claim 5, further comprising an activator positioned on an inner surface of the cable channel of the rear body and an outer surface of the tubular post, wherein the activator is structurally configured to harden released adhesive.

7. The coaxial cable connector assembly of claim 1, further comprising a hardener reservoir positioned at least partially within the cable channel of the rear body, the hardener reservoir comprising a hardener and a hardener reservoir breakable material that encapsulates the hardener, wherein the hardener reservoir breakable material is structurally configured to fracture upon application of a breaking force exceeding a predetermined threshold, thereby releasing the hardener from the hardener reservoir to react with.

8. The coaxial cable connector assembly of claim 1, wherein the coaxial cable connector assembly further comprises a plurality of reservoirs positioned at least partially within the cable channel of the rear body, each of the plurality of reservoirs comprising at least one of the adhesive and a hardener positioned within a hardener reservoir breakable material, wherein the hardener reservoir breakable material is structurally configured to fracture upon the application of force exceeding a predetermined threshold, thereby releasing the at least one of the adhesive and the hardener to couple the coaxial cable to the rear body.

9. The coaxial cable connector assembly of claim 1, wherein the adhesive reservoir breakable material is structurally configured to fracture upon the application of force as the coaxial cable is inserted into the rear body.

10. The coaxial cable connector assembly of claim 1, further comprising a reservoir rupturing member that is spaced apart from the reservoir engagement member, wherein the reservoir engagement member is positionable from a disengaged position, in which the adhesive is encapsulated within the adhesive reservoir, and an engaged position, in which the adhesive reservoir is engaged with the reservoir rupturing member.

11. The coaxial cable connector assembly of claim 1, further comprising a hardener reservoir positioned at least partially within the cable channel of the rear body, the hardener reservoir comprising a hardener and a hardener reservoir breakable material that encapsulates the hardener, wherein the hardener reservoir breakable material of the hardener reservoir is structurally configured to fracture upon application of a breaking force exceeding a predetermined threshold, thereby releasing the hardener from the hardener reservoir to react with released adhesive, wherein the adhesive reservoir and the hardener reservoir are positioned on opposite sides of the reservoir engagement member.

12. The coaxial cable connector assembly of claim 1, further comprising a hardener reservoir positioned at least partially within the cable channel of the rear body, the hardener reservoir comprising a hardener and a hardener reservoir breakable material that encapsulates the hardener, wherein the hardener reservoir breakable material of the hardener reservoir is structurally configured to fracture upon application of a breaking force exceeding a predetermined threshold, thereby releasing the hardener from the hardener reservoir to react with released adhesive, wherein the adhesive reservoir and the hardener reservoir are positioned on the same side of the reservoir engagement member.

* * * * *